US007739952B2

(12) United States Patent
Sakamoto

(10) Patent No.: US 7,739,952 B2
(45) Date of Patent: Jun. 22, 2010

(54) PRINTING APPARATUS AND METHOD OF TENSION CONTROL

(75) Inventor: Takashi Sakamoto, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 295 days.

(21) Appl. No.: 11/515,895

(22) Filed: Sep. 6, 2006

(65) Prior Publication Data

US 2007/0051264 A1 Mar. 8, 2007

(30) Foreign Application Priority Data

Sep. 7, 2005 (JP) ..... 2005-258965

(51) Int. Cl.

| | |
|---|---|
| ***B41F 1/54*** | (2006.01) |
| ***B41F 1/66*** | (2006.01) |
| ***B41F 5/04*** | (2006.01) |
| ***B41F 13/02*** | (2006.01) |
| ***B41L 5/12*** | (2006.01) |
| ***B41L 39/00*** | (2006.01) |
| ***B41L 47/56*** | (2006.01) |

(52) U.S. Cl. ..... 101/484; 101/219

(58) Field of Classification Search ..... 101/219, 101/220, 222, 223, 484, DIG. 42
See application file for complete search history.

(56) References Cited

U.S. PATENT DOCUMENTS 3,561,654 A * 2/1971 Greiner ..... 226/25
6,092,466 A * 7/2000 Koch et al. ..... 101/485
6,106,177 A * 8/2000 Siegl et al. ..... 400/618
6,176,410 B1 * 1/2001 Ueda et al. ..... 226/4
6,334,564 B1 * 1/2002 Kishine et al. ..... 226/42
6,499,639 B2 * 12/2002 Cote et al. ..... 226/42
6,659,006 B2 * 12/2003 Brennan et al. ..... 101/225
6,782,818 B2 * 8/2004 Glockner et al. ..... 101/228
7,067,039 B2 * 6/2006 Almi et al. ..... 162/193

FOREIGN PATENT DOCUMENTS

JP 2002-248743 9/2002

* cited by examiner

*Primary Examiner*—Judy Nguyen
*Assistant Examiner*—Leo T Hinze
(74) *Attorney, Agent, or Firm*—McDermott Will & Emery LLP

(57) ABSTRACT

A printing apparatus performs printing on a web of printing paper while transporting the printing paper along a transport path. The printing apparatus includes a first transport mechanism located upstream in the transport path, and a second transport mechanism located downstream in the transport path. The transport speed of the printing paper in the first transport mechanism is controlled so that a tension value measured by a first tension sensor provided near the first transport mechanism approaches a predetermined value. The transport speed of the printing paper in the second transport mechanism is controlled so that a tension value measured by a second tension sensor provided near the second transport mechanism approaches the tension value measured by the first tension sensor. Thus, the tension of the printing paper is maintained at the predetermined value in the two locations along the transport path. The printing apparatus presents no hunting problem because the tension control using the predetermined value as a target value is effected only in the first transport mechanism.

12 Claims, 4 Drawing Sheets

PRINTING APPARATUS AND METHOD OF TENSION CONTROL

BACKGROUND OF THE INVENTION

1. Field of the Invention

The present invention relates to a technique for controlling the tension of a web of printing paper in a printing apparatus for printing on the printing paper while transporting the printing paper along a predetermined transport path.

2. Description of the Background Art

A web printing apparatus for printing on a web (or elongated piece) of printing paper while transporting the printing paper along a predetermined transport path has been conventionally known. The web printing apparatus performs printing in a predetermined printing position on the printing paper while transporting the printing paper by using a plurality of rollers including an infeed roller, an outfeed roller and the like.

Such a web printing apparatus applies a predetermined tension to the printing paper to ensure the flatness of the printing paper in the printing position. Conventional techniques have applied a predetermined tension to the printing paper by setting the rotation speeds of the respective rollers for transporting the printing paper at values increasing gradually in a downstream direction along the transport path. Such techniques, however, have required a user to perform the operation of setting the rotation speeds of the respective rollers. Additionally, the user has been required to set the rotation speeds of the respective rollers again each time the type of printing paper to be used is changed.

Japanese Patent Application Laid-Open No. 2002-248743 discloses a printing apparatus which measures the tension of printing paper to effect feedback control of the rotation speed of an infeed roller so that the result of measurement approaches a predetermined value. Such tension control eliminates the need for the user to set the rotation speeds of the rollers, and also achieves the automatic control of the tension of the printing paper regardless of the type of the printing paper used.

However, when the tension control disclosed in Japanese Patent Application Laid-Open No. 2002-248743 is effected in a plurality of locations in a web printing apparatus, there arises a so-called "hunting" problem. FIG. 5 is a graph showing variations in the tension of the printing paper in two (first and second) control positions in a web printing apparatus when the tension control disclosed in Japanese Patent Application Laid-Open No. 2002-248743 is effected in the two control positions. The abscissa of FIG. 5 represents time, and the ordinate thereof represents the tension value. The tension in the first control position (indicated by the solid curve of FIG. 5) and the tension in the second control position (indicated by the dash-and-dot curve of FIG. 5) are controlled to approach a predetermined value pv. However, because the web printing apparatus handles a single continuous piece of printing paper, the tension in the first control position and the tension in the second control position interact with each other. For this reason, the tension in the first control position and the tension in the second control position do not converge to the predetermined value pv but repeatedly swing on both sides of the predetermined value pv. Thus, it has been difficult for the tension control disclosed in Japanese Patent Application Laid-Open No. 2002-248743 to maintain the tension of the printing paper in the plurality of locations in the web printing apparatus at a constant value.

SUMMARY OF THE INVENTION

The present invention is intended for a printing apparatus for printing on a web of printing paper while transporting the printing paper along a predetermined transport path.

According to the present invention, the printing apparatus comprises: a plurality of measuring parts for measuring the tension of the printing paper in a plurality of locations, respectively, along the transport path; a plurality of transport parts for transporting the printing paper near the plurality of measuring parts, respectively; and a controller for controlling the transport speed of the printing paper in the plurality of transport parts, based on tension values measured by the plurality of measuring parts, the controller controlling the transport speed of the printing paper in a first transport part so that a tension value measured by one of the plurality of measuring parts which is located near the first transport part approaches a predetermined value, the first transport part being included among the plurality of transport parts, the controller controlling the transport speed of the printing paper in a second transport part so that tension values measured by two of the plurality of measuring parts which are located immediately upstream and downstream of the second transport part approach each other, the second transport part being included among the plurality of transport parts.

The tension of the printing paper is maintained at the predetermined value in the plurality of locations along the transport path. Because the tension control using the predetermined value as a target value is effected only in a single location, the occurrence of hunting resulting from the interaction between the tensions of the printing paper in the plurality of locations is avoided.

Preferably, the first transport part is located most upstream of all the plurality of transport parts along the transport path.

The transport part in which tension control using the predetermined value as a target value is effected is the transport part located most upstream in the transport path. This eliminates the need to provide another measuring part upstream of the first transport part, thereby reducing the number of measuring parts.

Preferably, the printing apparatus further comprises a plurality of printing parts provided in a plurality of locations, respectively, along the transport path. The plurality of measuring parts measuring the tension of the printing paper being introduced into the plurality of printing parts, respectively.

The tension of the printing paper is maintained at the constant value in the plurality of printing parts. Therefore, the printing position and print quality are consistent in the plurality of printing parts.

Preferably, each of the plurality of printing parts is an inkjet printing part.

The flatness of the printing paper especially required for the inkjet printing part is ensured.

Preferably, the printing apparatus further comprises a delivery part located most downstream in the transport path for transporting the printing paper outwardly at a constant speed.

While maintaining the delivery speed of the printing paper in the delivery part at the constant speed, the printing apparatus can control the transport speed of the printing paper in the plurality of transport parts by using the delivery speed as a reference. Therefore, the tension of the printing paper is suitably controlled.

The present invention is also intended for a method of controlling the tension of a web of printing paper in a printing apparatus, the printing apparatus printing on the printing paper while transporting the printing paper along a predetermined transport path.

It is therefore an object of the present invention to provide a technique capable of maintaining the tension of printing paper at a constant value in a plurality of positions along a transport path in a web printing apparatus.

These and other objects, features, aspects and advantages of the present invention will become more apparent from the following detailed description of the present invention when taken in conjunction with the accompanying drawings.

DESCRIPTION OF THE PREFERRED EMBODIMENTS

A preferred embodiment according to the present invention will now be described with reference to the drawings.

<1. Construction of Printing Apparatus>

Figure 1:
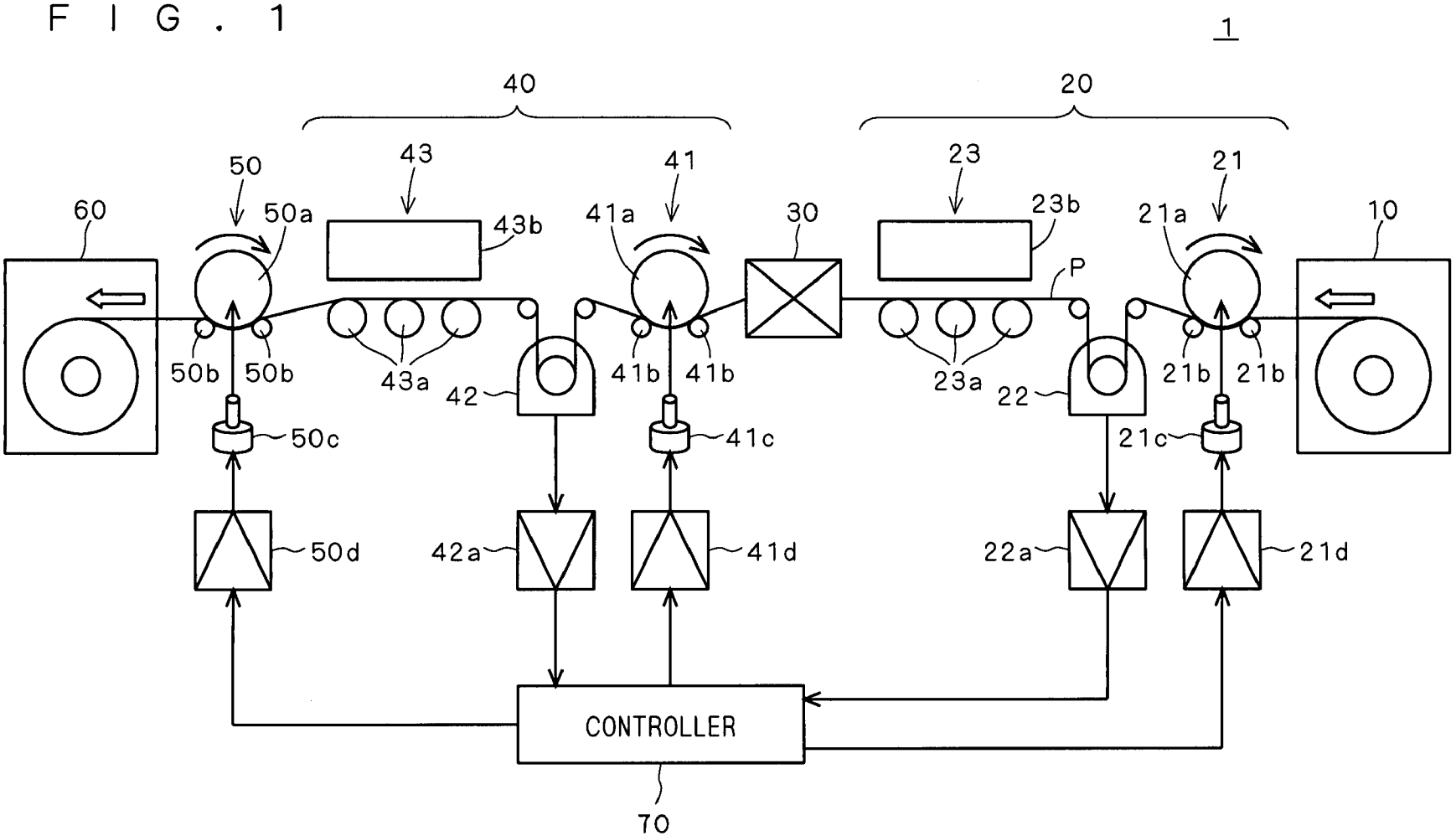
FIG. 1 shows a construction of a printing apparatus according to the present invention.

FIG. 1 shows a construction of a printing apparatus 1 according to a preferred embodiment of the present invention. The printing apparatus 1 of FIG. 1 is a web printing apparatus which performs printing on opposite sides (or first and second surfaces) of a web (or elongated piece) of printing paper P while transporting the web of printing paper P. The printing apparatus 1 principally comprises a feed part 10 for supplying the printing paper P, a first transport path part 20 for printing on the first surface of the printing paper P while transporting the printing paper P, a reversing part 30 for reversing the printing paper P to exchange the first and second surfaces for each other, a second transport path part 40 for printing on the second surface of the printing paper P while transporting the printing paper P, a delivery part 50 for transporting the printing paper P outwardly, and a take-up part 60 for receiving the outwardly transported printing paper P.

A first transport mechanism 21, a first tension sensor 22 and a first printing part 23 are provided in the first transport path part 20. The first transport mechanism 21 is a mechanism for transporting the printing paper P between the feed part 10 and the first tension sensor 22. The first transport mechanism 21 includes an infeed roller 21*a* and a plurality of nip rollers 21*b*. The first transport mechanism 21 transports the printing paper P downstream in the transport path of the printing paper P by rotating the infeed roller 21*a* while holding the printing paper P between the infeed roller 21*a* and the plurality of nip rollers 21*b*. The infeed roller 21*a* is coupled to a first motor 21*c*, and is rotated by running the first motor 21*c*.

The first tension sensor 22 is a sensor for measuring the tension of the printing paper P in the first transport path part 20. The first tension sensor 22 is provided between the first transport mechanism 21 and the first printing part 23, and measures the tension of the printing paper P being introduced into the first printing part 23. The first tension sensor 22 may be constructed by using various known pressure sensors. As an example, the first tension sensor 22 may be constructed in such a manner as to convert the pressure received by a roller because of the tension of the printing paper P into an electrical signal through a strain gauge to obtain the electrical signal.

The first printing part 23 is an inkjet printing part for printing on the first surface of the printing paper P. The first printing part 23 includes a plurality of rollers 23*a* serving as a portion of the transport path of the printing paper P, and a print head 23*b* for ejecting ink toward the printing paper P. The printing paper P is transported, with the first surface thereof positioned to face upward, while being maintained flat on the plurality of rollers 23*a*. The print head 23*b* has a plurality of ink ejection parts (not shown). The print head 23*b* performs printing on the first surface of the printing paper P by ejecting ink from the ink ejection parts toward the printing paper P being transported on the rollers 23*a*.

The reversing part 30 is a mechanism for reversing the printing paper P transported from the first transport path part 20 to exchange the first and second surfaces for each other, and then passing the reversed printing paper P to the second transport path part 40. The reversing part 30 includes, for example, a combination of turn bars for changing the angle of transport of the printing paper P.

A second transport mechanism 41, a second tension sensor 42 and a second printing part 43 are provided in the second transport path part 40. The second transport mechanism 41 is a mechanism for transporting the printing paper P between the reversing part 30 and the second tension sensor 42. The second transport mechanism 41 includes an intermediate roller 41*a* and a plurality of nip rollers 41*b*. The second transport mechanism 41 transports the printing paper P downstream in the transport path of the printing paper P by rotating the intermediate roller 41*a* while holding the printing paper P between the intermediate roller 41*a* and the plurality of nip rollers 41*b*. The intermediate roller 41*a* is coupled to a second motor 41*c*, and is rotated by running the second motor 41*c*.

The second tension sensor 42 is a sensor for measuring the tension of the printing paper P in the second transport path part 40. The second tension sensor 42 is provided between the second transport mechanism 41 and the second printing part 43, and measures the tension of the printing paper P being introduced into the second printing part 43. The second tension sensor 42 may be constructed by using various known pressure sensors. As an example, the second tension sensor 42 may be constructed in such a manner as to convert the pressure received by a roller because of the tension of the printing paper P into an electrical signal through a strain gauge to obtain the electrical signal.

The second printing part 43 is an inkjet printing part for printing on the second surface of the printing paper P. The second printing part 43 includes a plurality of rollers 43*a* serving as a portion of the transport path of the printing paper P, and a print head 43*b* for ejecting ink toward the printing paper P. The printing paper P is transported, with the second surface thereof positioned to face upward, while being maintained flat on the plurality of rollers 43*a*. The print head 43*b* has a plurality of ink ejection parts (not shown). The print head 43*b* performs printing on the second surface of the printing paper P by ejecting ink from the ink ejection parts toward the printing paper P being transported on the rollers 43*a*.

The delivery part 50 is a mechanism for transporting the printing paper P printed in the second printing part 43 outwardly to the take-up part 60. The delivery part 50 includes an outfeed roller 50*a* and a plurality of nip rollers 50*b*. The delivery part 50 transports the printing paper P to the take-up part 60 by rotating the outfeed roller 50*a* while holding the printing paper P between the outfeed roller 50*a* and the plurality of nip rollers 50*b*. The outfeed roller 50*a* is coupled to a third motor 50*c*, and is rotated by running the third motor 50*c*.

The printing apparatus 1 further comprises a controller 70 for controlling the operations of the above-mentioned components. The controller 70 is implemented by a computer having a CPU, a memory, and the like. The controller 70 is electrically connected through a first driver 21*d* to the first motor 21*c*. The controller 70 provides a pulse signal to the first driver 21*d* to run the first motor 21*c*, thereby rotating the infeed roller 21*a*. The controller 70 is also electrically connected through a second driver 41*d* to the second motor 41*c*. The controller 70 provides a pulse signal to the second driver 41*d* to run the second motor 41*c*, thereby rotating the intermediate roller 41*a*. The controller 70 is also electrically connected through a third driver 50*d* to the third motor 50*c*. The controller 70 provides a pulse signal to the third driver 50*d* to run the third motor 50*c*, thereby rotating the outfeed roller 50*a*.

The first tension sensor 22 is electrically connected through a first tension meter 22*a* to the controller 70. The first tension sensor 22 measures the tension of the printing paper P to transmit the measured tension in the form of an electrical signal to the first tension meter 22*a*. The first tension meter 22*a* transmits the electrical signal received from the first tension sensor 22 as a first measured value to the controller 70.

The second tension sensor 42 is electrically connected through a second tension meter 42*a* to the controller 70. The second tension sensor 42 measures the tension of the printing paper P to transmit the measured tension in the form of an electrical signal to the second tension meter 42*a*. The second tension meter 42*a* transmits the electrical signal received from the second tension sensor 42 as a second measured value to the controller 70.

<2. Tension Control of Printing Paper>

Next, the tension control of the printing paper P in the above-mentioned printing apparatus 1 will be described. This printing apparatus 1 controls the tension of the printing paper P by adjusting the rotation speed of the infeed roller 21*a* and the intermediate roller 41*a* while rotating the outfeed roller 50*a* at a predetermined constant speed. The printing paper P is transported outwardly to the take-up part 60 at the constant speed by the outfeed roller 50*a*. The speeds at which the infeed roller 21*a* and the intermediate roller 41*a* transport the printing paper P become slightly different from the speed at which the outfeed roller 50*a* transports the printing paper P outwardly. This maintains the tension of the printing paper P in the first transport path part 20 and in the second transport path part 40 at a constant value.

Figure 2:
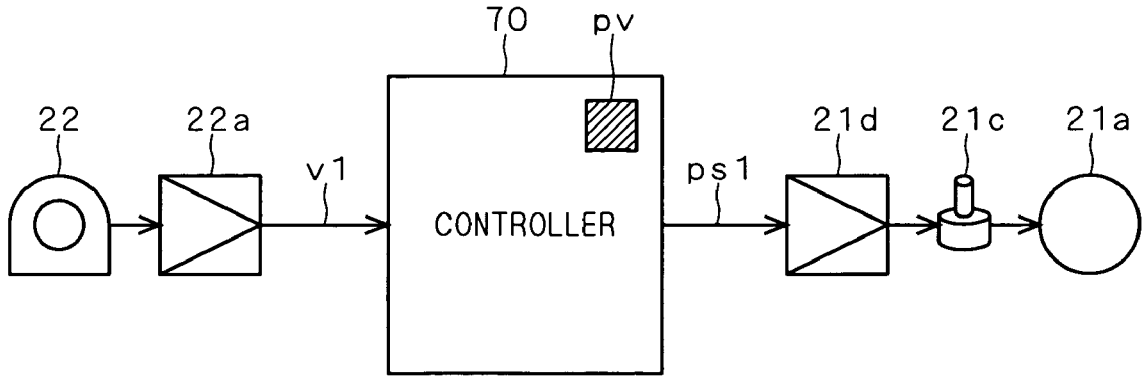
FIG. 2 is a block diagram showing the control of the rotation speed of an infeed roller.

FIG. 2 is a block diagram showing the control of the rotation speed of the infeed roller 21*a*. To control the infeed roller 21*a*, the controller 70 references the first measured value v1 received from the first tension sensor 22 through the first tension meter 22*a*. The controller 70 controls the rotation speed of the infeed roller 21*a* so that the first measured value v1 approaches a predetermined value pv stored in the controller 70. For example, when the first measured value v1 is less than the predetermined value pv, the controller 70 issues a pulse signal ps1 so as to decrease the rotation speed of the infeed roller 21*a*. When the first measured value v1 is greater than the predetermined value pv, the controller 70 issues the pulse signal ps1 so as to increase the rotation speed of the infeed roller 21*a*. Thus, the tension of the printing paper P in the first transport path part 20 converges to the predetermined value pv, and is stabilized.

Figure 3:
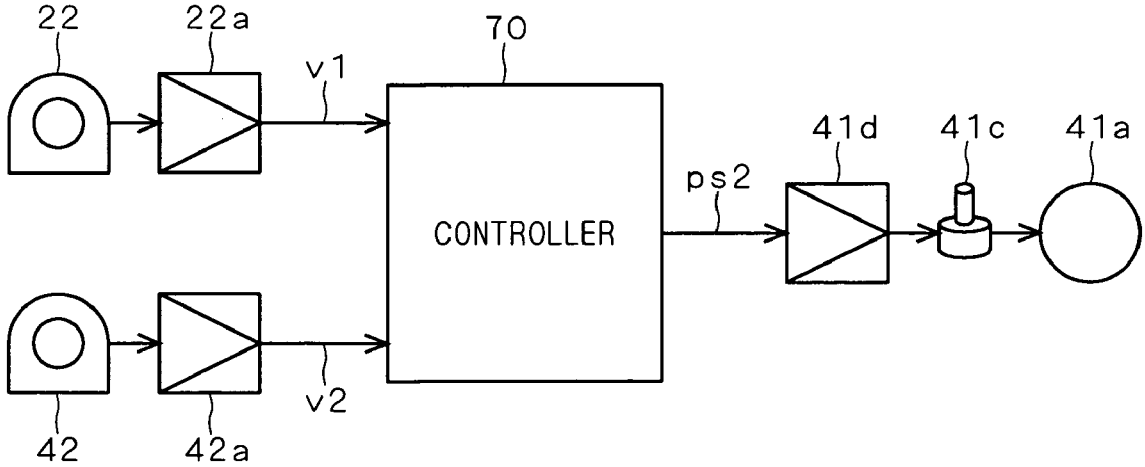
FIG. 3 is a block diagram showing the control of the rotation speed of an intermediate roller.

FIG. 3 is a block diagram showing the control of the rotation speed of the intermediate roller 41*a*. To control the intermediate roller 41*a*, the controller 70 references the first measured value v1 received from the first tension sensor 22 through the first tension meter 22*a*, and the second measured value v2 received from the second tension sensor 42 through the second tension meter 42*a*. The controller 70 controls the rotation speed of the intermediate roller 41*a* so that the second measured value v2 approaches the first measured value v1. For example, when the second measured value v2 is less than the first measured value v1, the controller 70 issues a pulse signal ps2 so as to decrease the rotation speed of the intermediate roller 41*a*. When the second measured value v2 is greater than the first measured value v1, the controller 70 issues the pulse signal ps2 so as to increase the rotation speed of the intermediate roller 41*a*. Thus, the tension of the printing paper P in the second transport path part 40 approaches the tension of the printing paper P in the first transport path part 20. As the tension of the printing paper P in the first transport path part 20 converges to the predetermined value pv, the tension of the printing paper P in the second transport path part 40 follows that of the printing paper P in the first transport path part 20 to converge to the predetermined value pv.

In the printing apparatus 1 as described above, the transport speed of the printing paper P in the first transport mechanism 21 is controlled so that the first measured value v1 measured by the first tension sensor 22 approaches the predetermined value pv. The transport speed of the printing paper P in the second transport mechanism 41 is controlled so that the second measured value v2 measured by the second tension sensor 42 approaches the first measured value v1 measured by the first tension sensor 22. Thus, the tension of the printing paper P in the first transport path part 20 and in the second transport path part 40 is maintained at the predetermined value pv. Because the tension control using the predetermined value pv as a target value is effected only in the first transport path part 20, the printing apparatus 1 presents no hunting problem resulting from the interaction between the tension of the printing paper P in the first transport path part 20 and the tension of the printing paper P in the second transport path part 40.

The printing apparatus 1 according to this preferred embodiment is the printing apparatus for printing on the first and second surfaces of the printing paper P. In such a printing apparatus 1, a difference in the tension of the printing paper P is prone to arise across the reversing part 30 unless particular control is exercised. However, effecting the above-mentioned tension control allows the tension of the printing paper P in both locations upstream and downstream of the reversing part 30 to be maintained at the predetermined value pv. Therefore, the same degree of stretch of the printing paper P is attained in the locations upstream and downstream of the reversing part 30, whereby the printing position and print quality are consistent on the first and second surfaces of the printing paper P.

The printing apparatus 1 according to this preferred embodiment is an inkjet printing apparatus. The flatness of the printing paper P in the printing position is especially required for the inkjet printing apparatus. The above-mentioned tension control ensures a high degree of flatness of the printing paper P in the first printing part 23 and in the second printing part 43.

<3. Modifications>

The control of the tension of the printing paper P in the two control positions (the first transport path part 20 and the second transport path part 40) along the transport path is described in the above-mentioned preferred embodiment. The present invention, however, may be adapted to control the tension of the printing paper P in at least three control positions.

Figure 4:
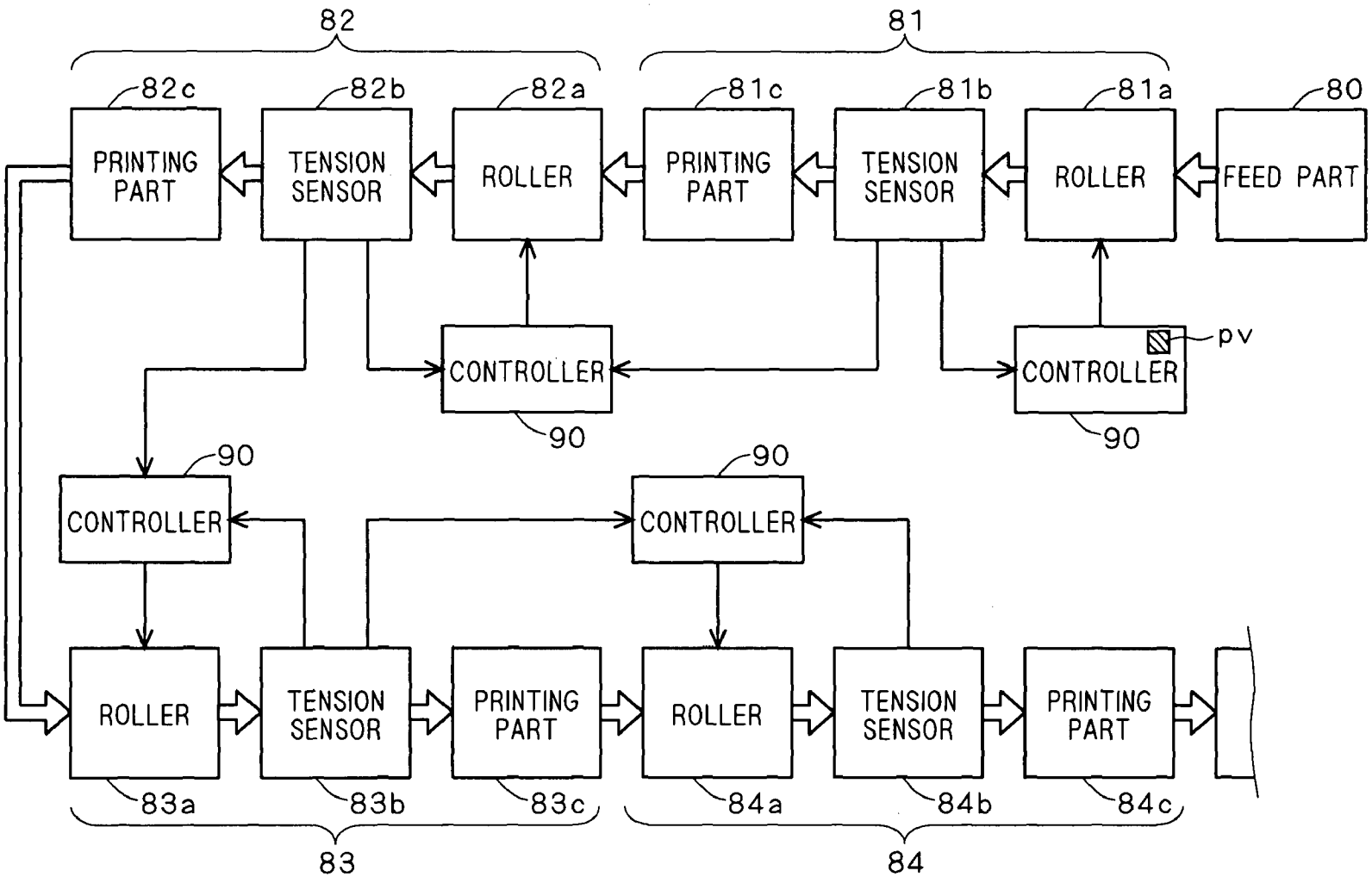
FIG. 4 schematically shows a construction of a printing apparatus which controls the tension of printing paper in at least three control positions.
Figure 5:
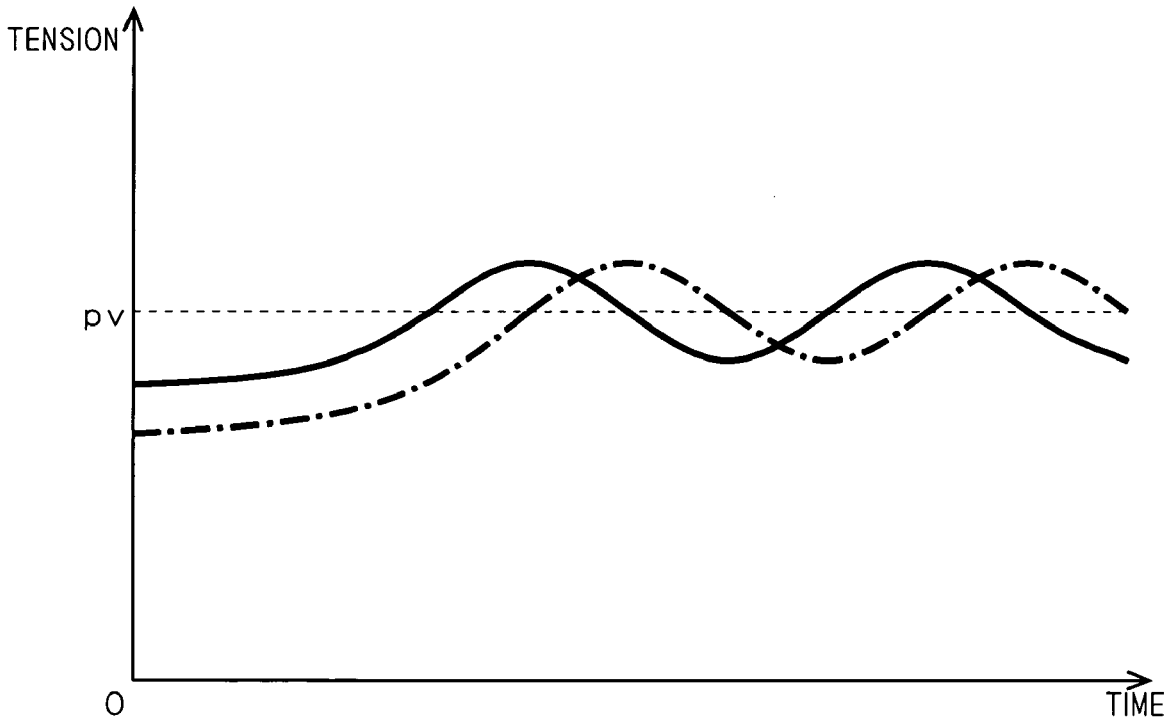
FIG. 5 is a graph showing variations in the tension of printing paper in two control positions when conventional tension control is effected in the two control positions.

FIG. 4 schematically shows a construction of a printing apparatus which controls the tension of the printing paper P in at least three control positions. The printing apparatus of FIG. 4 has a plurality of control positions 81, 82, 83, etc. along the transport path. Rollers 81*a*, 82*a*, 83*a*, etc., tension sensors 81*b*, 82*b*, 83*b*, etc., and printing parts 81*c*, 82*c*, 83*c*, etc. are provided in the control positions 81, 82, 83, etc., respectively. The printing paper P is supplied from a feed part 80, and is transported while passing through the control positions 81, 82, 83, etc. With such an arrangement, a controller 90 (although four controllers 90 are shown in FIG. 4 merely for purposes of illustration) controls the rotation speed of the roller 81*a* located most upstream in the transport path so that a tension value measured by the tension sensor 81*b* located adjacent to the roller 81*a* approaches the predetermined value pv. The controller 90 also controls the rotation speed of the remaining rollers 82*a*, 83*a*, etc. so that tension values measured by the respective tension sensors located immediately upstream and downstream of each of the rollers 82*a*, 83*a*, etc. approach each other. For example, the controller 90 controls the rotation speed of the roller 82*a* so that the tension value measured by the tension sensor 82*b* approaches the tension value measured by the tension sensor 81*b*, and controls the rotation speed of the roller 83*a* so that the tension value measured by the tension sensor 83*b* approaches the tension value measured by the tension sensor 82*b*. This maintains the tension of the printing paper P in the plurality of control positions 81, 82, 83, etc. at the predetermined value pv. Because the tension control using the predetermined value pv as a target value is effected only in the most upstream control position 81, the printing apparatus of FIG. 4 presents no hunting problem resulting from the interaction between the tensions of the printing paper P in the respective control positions 81, 82, 83, etc.

In the above-mentioned modification shown in FIG. 4, the control position in which the tension control is effected using the predetermined value pv as a target value is only the most upstream control position 81, but is not limited to the most upstream control position 81. However, if the control position in which the tension control is effected using the predetermined value pv as a target value is determined as any one of the intermediate control positions 82, 83, etc., there arises a need to locate an additional tension sensor upstream of the most upstream control position 81, resulting in slight increase in the size of the printing apparatus. It is hence desirable that the control position in which the tension control is effected using the predetermined value pv as a target value is the most upstream control position 81.

Although the inkjet printing apparatus is described above, the present invention is not limited to the inkjet printing apparatus, but is applicable to other types of printing apparatuses.

While the invention has been described in detail, the foregoing description is in all aspects illustrative and not restrictive. It is understood that numerous other modifications and variations can be devised without departing from the scope of the invention.

What is claimed is:

1. A printing apparatus for printing on a web of printing paper while transporting the printing paper along a predetermined transport path, comprising:

a plurality of measuring parts for measuring the tension of said printing paper in a plurality of locations, respectively, along said transport path;

a plurality of transport parts for transporting said printing paper near said plurality of measuring parts, respectively; and a controller for controlling the transport speed of said printing paper in said plurality of transport parts, based on tension values measured by said plurality of measuring parts, (i) said controller controlling the transport speed of said printing paper in a first transport part with a controlling target so that a tension value measured by one of said plurality of measuring parts which is located near said first transport part approaches a predetermined value, said first transport part being located most upstream among said plurality of transport parts, (ii) said controller controlling the transport speed of said printing paper in a second transport part with the controlling target so that tension values measured by two of said plurality of measuring parts which are located immediately upstream and downstream of said second transport part are referenced and that the two measured tension values approach each other, said second transport part being included among said plurality of transport parts, and only said first transport part among said plurality of transport parts being controlled with a control target using said predetermined value as a target value.

2. The printing apparatus according to claim 1, further comprising a plurality of printing parts provided in a plurality of locations, respectively, along said transport path, said plurality of measuring parts measuring the tension of said printing paper being introduced into said plurality of printing parts, respectively.

3. The printing apparatus according to claim 2, wherein each of said plurality of printing parts is an inkjet printing part.

4. The printing apparatus according to claim 3, further comprising a delivery part located most downstream in said transport path for transporting said printing paper outwardly at a constant speed.

5. The printing apparatus according to claim 4, wherein said plurality of printing parts include a first printing part for printing on a first surface of said printing paper, and a second printing part for printing on a second surface of said printing paper.

6. The printing apparatus according to claim 5, further comprising a reversing part provided between said first printing part and said second printing part for reversing said printing paper to exchange the first and second surfaces of said printing paper for each other.

7. A method of controlling the tension of a web of printing paper in a printing apparatus, said printing apparatus printing on said printing paper while transporting said printing paper along a predetermined transport path, said method comprising the steps of:

(a) measuring the tension of said printing paper in a plurality of measuring positions along said transport path; and (b) controlling the transport speed of said printing paper in a plurality of transport positions provided near said plurality of measuring positions, respectively, wherein, in said step (b), (i) the transport speed of said printing paper in a first transport position is controlled with a controlling target so that a tension value measured in one of said plurality of measuring positions which is located near said first transport position approaches a predetermined value, said first transport position being located most upstream among said plurality of transport positions, (ii) the transport speed of said printing paper in a second transport position is controlled with the controlling target so that tension values measured in two of said plurality of measuring positions which are located immediately upstream and downstream of said second transport position are referenced and that the two measured tension values approach each other, said second transport position being included among said plurality of transport positions, and only said first transport position among said plurality of transport positions being controlled with a control target using said predetermined value as a target value.

8. The method according to claim 7, further comprising the step of (c) performing printing on said printing paper in a plurality of printing positions along said transport path, wherein the tension of said printing part being introduced into each of said plurality of printing positions is measured in said step (a).

9. The method according to claim 8, wherein inkjet printing is performed in said step (c).

10. The method according to claim 9, further comprising the step of (d) transporting said printing paper in a location most downstream in said transport path outwardly at a constant speed.

11. The method according to claim 10, wherein printing is performed on a first surface of said printing paper in a first printing position and is performed on a second surface of said printing paper in a second printing position in said step (c), said first printing position and said second printing position being included among said plurality of printing positions.

12. The method according to claim 11, further comprising the step of (e) reversing said printing paper to exchange the first and second surfaces of said printing paper for each other in a location lying between said first printing position and said second printing position.

* * * * *